United States Patent [19]

Takematsu

[11] 4,382,211

[45] May 3, 1983

[54] ELECTRIC FLASH DEVICE

[75] Inventor: Yoshiyuki Takematsu, Tokyo, Japan

[73] Assignee: Fuji Koeki Corporation, Tokyo, Japan

[21] Appl. No.: 204,797

[22] Filed: Nov. 7, 1980

[30] Foreign Application Priority Data

Nov. 7, 1979 [JP] Japan ..... 54-144712
Nov. 30, 1979 [JP] Japan ..... 54-155005

[51] Int. Cl.[3] ..... H05B 41/32

[52] U.S. Cl. ..... 315/151; 315/159; 315/241 P

[58] Field of Search ..... 315/151, 159, 241 P; 354/145; 320/1; 250/214 P

[56] References Cited

U.S. PATENT DOCUMENTS 4,162,426 7/1979 Tsunekawa et al. ..... 315/151
4,204,140 5/1980 Willis ..... 315/241 P
4,224,555 9/1980 Ishikawa ..... 315/151
4,256,994 3/1981 Ikawa ..... 315/151

FOREIGN PATENT DOCUMENTS 48-38413 11/1973 Japan .
52-47327 12/1977 Japan .

*Primary Examiner*—Eugene R. La Roche
*Attorney, Agent, or Firm*—Fleit, Jacobson & Cohn

[57] ABSTRACT

An electronic flash device having a battery, means for converting the battery voltage to alternating current voltage, means for rectifying the alternating current voltage to direct current voltage, a main storage capacitor charged by the direct current voltage, a flash tube in parallel with the storage capacitor, a trigger circuit for firing the flash tube and a control circuit for stopping the flash operation of the flash tube when a predetermined amount of light has been reflected from an object to be photographed. The control circuit is actuated by a light measuring circuit which senses the reflected light. A switch element connects the light measuring circuit to the battery during activation of the flash tube.

16 Claims, 9 Drawing Figures

ELECTRIC FLASH DEVICE

FIELD OF THE INVENTION

The present invention relates to a flash light generating apparatus, and more particularly to an electric flash device which generates a flash light by energizing a flash tube.

BACKGROUND OF THE INVENTION

Flash apparatus has become widely used in various kinds of optical apparatus of which the operation requires flash light. Particularly, in the art of photography, artificial light is used to illuminate an object to be photographed. One form of artificial light which is now widely used is the so-called flash tube.

It is common practice in electric flash devices to obtain high intensity illumination for photographic purposes by discharging a charged capacitor through a gas-filled flash tube. A low voltage D.C. power source is generally employed together with suitable circuitry in order to obtain the relatively high D.C. voltage which is needed to charge the flash capacitor for each firing of the flash tube.

To perform the flash photographing efficiently, it is necessary to control flash light quantity of the flash tube, notwithstanding flash timing of the flash tube.

It can readily be understood that under ordinary circumstances when an electric flash device is being used, the flash device requires a flash light exposure control circuit for sensing the light from the flash tube in order to perform efficiently flash light control.

In a conventional flash device, a driving power is supplied from a main storage capacitor which is used to generate the flash light in the flash tube. Accordingly, it is very inconvenient to supply the driving power to the exposure control circuit, since the power source by the main storage capacitor is likely to be lack to actuate the exposure control circuit.

Further, in thus conventional electric flash device, there was a disadvantage that circuit construction is relatively complicated, since the device is constructed such that the voltage is applied from a main electric charge storing capacitor to a flash light control circuit during a flash tube flashes.

OBJECT OF THE INVENTION

An object of the present invention is the provision of a high performance electric flash device which can operate effectively flash light quantity.

An object of the present invention is the provision of a high performance electric flash device which can use efficiently an electric power of a power source circuit as a driving power source of a flash light control circuit.

SUMMARY OF THE INVENTION

According to the present invention there is provided an electric flash device comprising electric power supplying means for supplying electric power, electrical energy storing means, flash light generating means for converting the electrical energy to light energy, trigger signal generating means for triggering said flash light generating means, flash light control means for controlling flash light, driving power source means for actuating said flash light control means, and power source control means.

BRIEF DESCRIPTION OF THE DRAWING

The other objects and features of the present invention will be best understood by the description of the preferred embodiments from the following description of specific embodiments when read in connection with the accompanying drawings.

DESCRIPTION OF THE PREFERRED EMBODIMENTS

Figure 1:
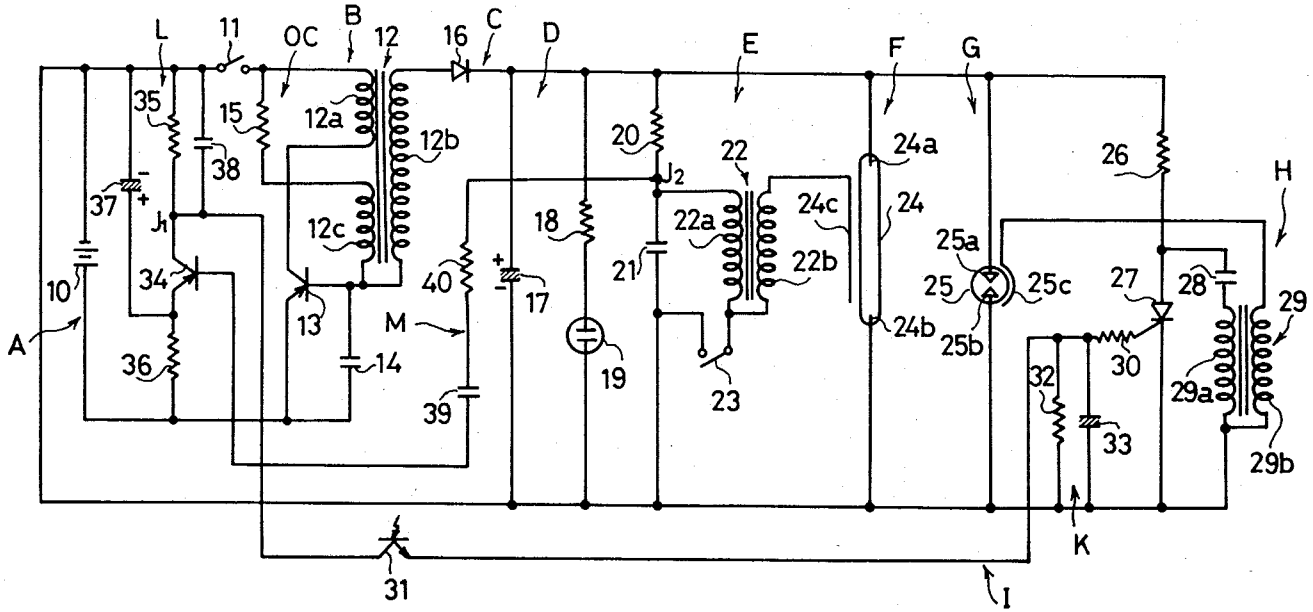
FIG. 1 is an electric diagram of an electric flash device in accordance with the embodiment of the present invention.

Referring to FIG. 1 of the drawings, there is shown an electric flash device according to the present invention. The electric flash device comprises, substantially, electric power supplying means for supplying electric power, electrical energy storing means for storing electrical energy supplied from said electric power supplying means, flash light generating means for converting the electric energy stored in said electric energy storing means to light energy, trigger signal generating means for triggering said flash light generating means, and flash light control means for controlling flash light quantity.

The power supply means comprises a low direct current power source circuit A for supplying a direct current power, a voltage converter circuit B for converting and boosting a direct current voltage from the direct current power source circuit A to a high alternating current voltage, and a rectifier circuit C for rectifying the high alternating current voltage to a high direct current voltage.

The electric energy storing means comprises an electric charge storing circuit D for storing an electric charge and for supplying the electric energy to the flash light generating means. The flash light generating means comprises a flash tube circuit F for generating flash light. The trigger signal generating means comprises a trigger signal generating circuit E for actuating the flash tube circuit F. The flash light control means comprises a quenching circuit G for quenching the flash tube circuit E, a quench trigger signal generating circuit H for triggering the quenching circuit G, a light receiving circuit I for sensing a flash light generated from the flash tube circuit F and thereafter reflected from an object to be photographed (not shown in the drawing) and for controlling the quench trigger signal generating circuit H, an integration circuit K for delaying the timing of the actuation of the quench trigger signal generating circuit H, a driving power source circuit L for supplying electric power to the light receiving circuit I, and a power source control circuit M for controlling actuating timing of the driving power source circuit L.

The power source circuit A has a battery 10 and a first power source switch 11 which is connected in series to the battery 10. The voltage converter circuit B comprises, substantially, an oscillator circuit OC. In more detail, the voltage converter circuit B includes an oscillating transformer 12 having at least two winding such as a primary winding 12*a*, a secondary winding 12*b* and a control winding 12*c*, an oscillating switch element in the form of an oscillating transistor 13, an oscillating capacitor 14 and a current-restricting resistor 15. One terminal of the primary winding 12*a* is connected to a negative terminal of the battery 10 by way of the first power source switch 11, and other terminal of the primary winding 12*a* is connected to a collector electrode in order to form the oscillator circuit OC. One terminal of the secondary winding 12*b* is connected to one terminal of the control winding 12*c*, and other terminal of the control winding 12*c* is connected to the negative terminal of the battery 10 by way of the power source switch 11. The voltage converter circuit B is, substantially, a voltage feed-back type oscillator circuit.

The rectifier circuit C includes an electric valve in the form of a diode 16 of which an anode electrode is connected to other terminal of the secondary winding 12*b* of the oscillating transformer 12. The electric charge storing circuit D comprises a main storage capacitor 17, a current-restricting resistor 18 and an indicating lamp in the form of a neon glow lamp 19 which is connected to the main storage capacitor 17 by way of the current-restricting resistor 18. One terminal of the capacitor 17 is connected to a cathode electrode of the diode 16, and the other terminal of the capacitor 17 is connected to the negative terminal of the battery 10.

The trigger signal generating circuit E has a protecting resistor 20 of which one terminal is connected to the one terminal of the main storage capacitor 17, a first trigger capacitor 21 of which one terminal is connected to the other terminal of the main storage capacitor 17, a first triggering transformer 22 having an input winding 22*a* and an output winding 22*b*, and synchronizing switch 23 which is arranged to be switch ON and OFF in synchronizing with a camera shutter. The flash tube circuit F includes a flash tube 24 which is provided with a pair of main current conducting electrodes 24*a*, 24*b* and a trigger electrode 24*c* which is positioned adjacent but external to the flash tube 24. The trigger electrode 24*c* is connected to one terminal of the output winding 22*b* of the triggering transformer 22, and the flash tube 24 is connected to the main storage capacitor 17 in parallel relationship. The quenching circuit G includes a quench tube 25 which is connected to the flash tube 24 of the flash tube circuit E in parallel relationship.

There are, of course, certain criteria that must be in quench tube 25. To operate effectively, the quench tube 25 must have a low impedance compared with the flash tube 24.

The quench trigger signal generating circuit H comprises a protecting resistor 26, a second trigger switch element in the form of a thyristor 27 connected in parallel with the quench tube 25 by way of the protecting resistor 26, a second trigger capacitor 28 and a second triggering transformer 29 of which an input winding 29*a* is connected in parallel with the thyristor 27 by way of the second triggering capacitor 27, and of which an output winding 29*b* is connected to a trigger electrode 25*c* of the quench tube 25.

The light receiving circuit I includes a light sensitive element in the form of a photo-transistor 31 which is connected to a gate electrode of the thyristor 27 by way of a gate resistor 30, and an integration circuit K which comprises a resistor 32 and an integrating capacitor 33 which are connected between the gate electrode and a cathode electrode of the thyristor 27 by way of the gate resistor 30.

The driving power source circuit L is connected to the power source circuit A and comprised by a current-restricting resistor 35, a second power switch in the form of a transistor 34 of which a collector electrode is connected to the negative terminal of the battery 10 by way of the current-restricting resistor 35, a protecting resistor 36 which is connected to an emitter electrode of the transistor 34 and the positive electrode of the battery 10, a charging capacitor 37 which is connected between the negative electrode of the battery 10 and the emitter electrode of the transistor 34 and a smoothing capacitor 38 which is connected in parallel with the resistor 35. The collector electrode of the transistor 34 is, further, connected to the photo-transistor 31 of the light receiving circuit I.

The power source control circuit M is provided between the driving power source circuit L and the trigger signal generating circuit E, and comprises a control capacitor 39 for controlling the bias voltage of the base electrode of the transistor 34 and a protecting resistor 40. The control capacitor 39 is connected to the base electrode of the transistor 34, and the protecting resistor 40 is connected to the control capacitor 39 and a juncture $J_2$ located between the protecting resistor 20 and a first trigger capacitor 21 of the trigger signal generating circuit E.

In operation, the first power source switch 11 is manually operated by its ON and OFF starter. When the first power source switch 11 is in its OFF state, the oscillator circuit OC does not also activate its oscillating operation, because the power source current is not supplied to the voltage converter circuit B. The second power source switch element in the form of the transistor 34 of the driving power source circuit L is also nonconductive, since the electric charge is not stored on the control capacitor 39. When the transistor 34 is nonconductive, electric charge is stored on the charging capacitor 37 at a polarity as shown in FIG. 1.

By turning the first power source switch 11 ON, the base electrode of the oscillating transistor 13 is biased to cause the transistor 13 to become conductive, since the base current is supplied to the transistor 13 from the battery 10 of the power source circuit A by way of the resistor 15 and the control winding 12*c* of the oscillating transformer 12. When the transistor 13 turns ON, current flows through the primary winding 12*a* of the oscillating transformer 12 from the battery 10 and, at the same time, the current flows through the control winding 12*c*, the oscillating capacitor 14, the battery 10 and the resistor 15, and the electric charge is accumulated on the oscillating capacitor 14, and thereby the voltage converter circuit B commences the oscillation and the high alternating current voltage is produced from the secondary winding 12*b* of the oscillating transformer 12. In this case, the control winding 12*c* operates to stabilize the oscillating operation, and the control winding 12*c* is not always required. The oscillating voltage due to the stray capacity of the windings of the transformer 12 or the oscillating capacitor 14 is also employed to make the oscillating transistor 13 ON and OFF operations. The high alternating current voltage is rectified by the diode 16 of the rectifier circuit C, to produce a high direct current voltage.

As each winding of the oscillating transformer 12 is wound so that the base current increases, the transistor 13 becomes conductive by means of positive feed-back operation of the transformer 12. The collector current almost linearly increases with respect to time and the induced voltage in the control winding 12*c*. The transcient component of the base current of the transistor 13 decreases, when the base current reaches to peak value which decided by the induced voltage and the resistor 15. That is to say, the increment of the collector current becomes nonlinear, and does not increase any longer. Accordingly, the induced voltage at the control winding 12*c* decreases, and thereby the base current of the transistor 13 decreases, and then the collector current decreases swiftly. By the decrement of the collector current, the transistor 13 is made cut-off state.

When the transistor 13 is non-conductive state, the current flowing through the control winding 12*c* of the oscillating transformer 12 is swiftly interrupted and then the energy stored on the oscillating resistor 14 appears at the control winding 12*c* as a reverse voltage with respect to the oscillating transformer 12 and the electric charge is stored on the oscillating capacitor 14. In this case, the charging current of the capacitor becomes oscillating current if leaving as it is, because the transistor 13 is cut-off. Under these condition, the current which flows in the primary winding 12*a* of the oscillating transformer 12 is also reversed at a half cycle of the oscillation of the charging current, and the voltage appears at the control winding 12*c* due to that current so as to bias the transistor 13 forwardly. The transistor 13 is, therefore, biased again to be conductive state.

The alternating current voltage induced at the secondary winding 12*b* is rectified by the diode 16, and thereby the current flows in a currnt loop formed by the secondary winding 12*b* of the oscillating transformer 12, the main storage capacitor 17, the battery 10, the emitter-base path of the oscillating transistor 13, and the diode 16. By this current, the electric charge is stored on the main storage capacitor 17 of the charging circuit D at a polarity as shown in FIG. 1, and, at the same time, the electric charge is also accumulated on the switching control capacitor 39 through the resistor 40 of the power source control circuit M. Further, the electric charge is stored on the trigger capacitor 21 and on the trigger capacitor 28. When the switching control capacitor 39 is charged, positive potential is applied to the base electrode of the transistor 34, and thereby the transistor 34 is biased to be nonconductive.

When the main storage capacitor 17 is fully charged to the predetermined and suitable voltage, the neon glow lamp 19 lights indicating that the device is in readiness for the flash tube 24 to be fired. The flash tube 24 may then be fired by closing of the synchronous switch 23 in synchronizing with the camera shutter. It will be appreciated that the closing of the switch 23 need only be momentary during the actuation of the camera shutter. By closing the switch 23, the electric charge on the trigger capacitor 21 discharges through the switch 23 and the input winding 22*a*. Then high voltage pulse such as 3000 volts induced at the output winding 22*b* of the triggering transformer 22 appears at the triggering electrode 24*c* of the flash tube 24. The main storage capacitor 17 then discharges across the gas between the main current conducting electrode 24*a* and 24*b*, producing a brilliant flash of illumination.

When the main storage capacitor 17 discharges the electric charge, the terminal voltage of the main storage capacitor 17 decreases. Under these conditions, a closed loop is formed by the switch control capacitor 39, the protecting resistor 40, the input winding 22*a* of the triggering transformer 22, the switch 23, the current-restricting resistor 35 and a collector-base path of the transistor 34 during the switch 23 is closed.

Accordingly, the electric charge stored on the switch control capacitor 39 is also discharged through the above described closed loop, and thereby a negative potential appears at the base electrode of the transistor 34 of the driving power source circuit L. By the negative potential, the transistor 27 is rendered to be conductive. When the transistor 34 becomes conductive, electric charge stored on the charging capacitor 37 is discharged to the photo-transistor 31 of the light receiving circuit I by way of the emitter-collector path of the transistor 34. The photo-transistor 31 senses light reflected from an object to be photographed (not shown in the drawing) and becomes conductive. Accordingly, discharging current supplied to the integration circuit K through the photo-transistor 31, and a gating signal applied to the gate electrode of the thyristor 27 of the quench trigger signal generating circuit H to make the thyristor 27 conductive from the integration circuit K after the delayed time.

When the thyristor 27 becomes conductive, the electric charge stored on the second trigger capacitor 28 is discharged through the thyristor 27, the input winding 29*a*, and thereby the high voltage pulse generates in the output winding 29*b*. The high voltage pulse induced at the output winding 29*b* is applied to the triggering electrode 25*c* of the quench tube 25 of the quenching circuit G, and the quench tube 25 is activated to be conductive. When the quench tube 25 becomes conductive, the discharging current from the main storage capacitor 17 of the electric charge storing circuit D is by-passed by the quench tube 25 to stop the flash operation of the flash tube 24 of the flash tube circuit F, because the internal resistance of the quench tube 25 is smaller than that of the flash tube 24.

Additionally, the smoothing capacitor 37 activates to stabilize the direct current voltage to be applied to the photo-transistor 31 by eliminating fluctuation of the voltage of the direct current power source circuit A, since the voltage of the circuit A is fluctuated during the oscillator circuit OC of the voltage converter circuit B activates the oscillating operation.

According to the electric flash device of FIG. 1, the driving power source circuit L for driving the light sensitive circuit I is comprised by the charging capacitor 37 which is connected in parallel with the battery 10 of the direct current power source circuit A and the second power source switch element in the form of the transistor 34 which is connected with the charging capacitor 37. The discharging current from the charging capacitor 37 is supplied to the photo-sensitive element in the form of the photo-transistor 31 of the light receiving circuit I by switching ON the transistor 34 approximately in synchronism with the actuation of the flash tube circuit F.

Accordingly, the electric power required to stabilize the operation of the light receiving circuit I can be obtained from the low impedance driving power source circuit L, without using a portion of the main storage capacitor 17 of the electric charge storing circuit D. It is, therefore, appreciated that the rise time of applied voltage to the light receiving circuit I is made fast and thereby the considerable light exposure condition can be obtained, since the adequate electric power is supplied to the light receiving circuit I in order to perform the accurate controlling of the flash light of the flash tube 24.

Figure 2:
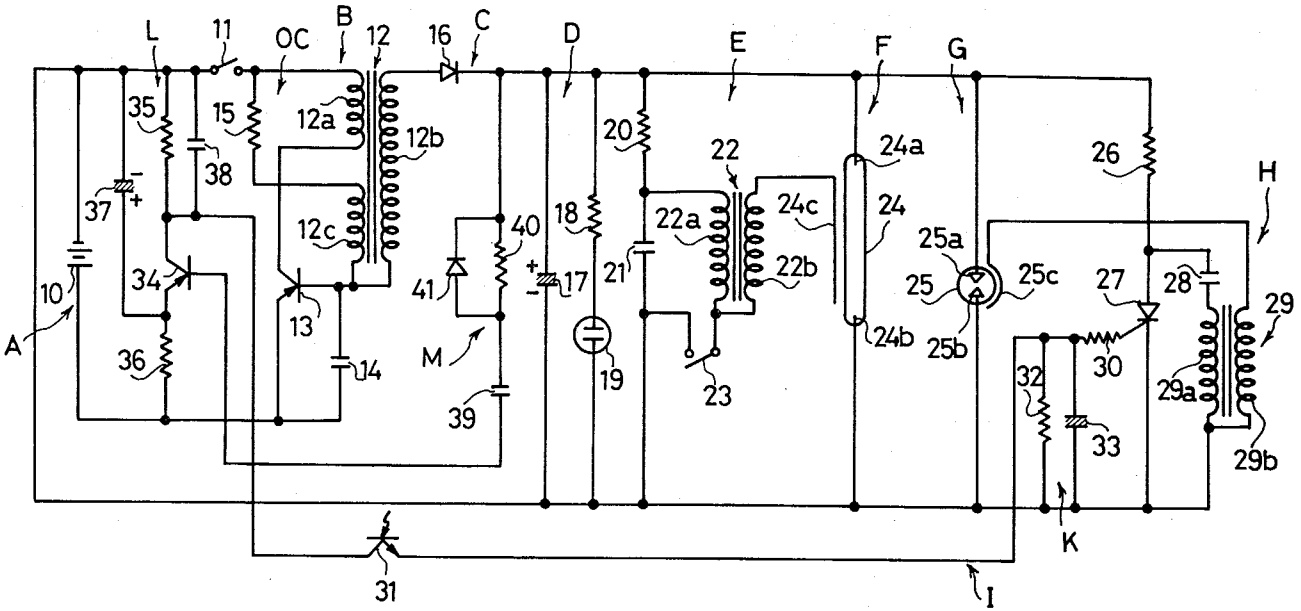
FIG. 2 is an electric diagram of a modification of the electric flash device of FIG. 1.

FIG. 2 shows a modification of the device of FIG. 1. In the device shown in FIG. 2, a power source control circuit M is provided between a driving power source circuit L and an electric charge storing circuit D. In more detail, the driving power source circuit L comprises a second power source switch in the form of a transistor 34 of which a collector-emitter path is connected to a battery 10 of a power source circuit A in parallel relationship by way of resistors 35 and 36, and a charging capacitor 37 which is connected to the battery 10 by way of the resistor 36. The power source control circuit M comprises a control capacitor 39 of which one terminal is connected to a base electrode of the transistor 34, a protecting resistor 40 which is connected between other terminal of the control capacitor 39 and a juncture located between a rectifier circuit C and the electric charge storing circuit D, and a diode 41 connected to the resistor 40 in parallel relationship.

In accordance with the device of FIG. 2, when a main storage capacitor 17 is fully charged, the flash tube 24 may be fired by closing of a switch 23 in synchronizing with a camera shutter. By closing the switch 23, electric charge stored on a trigger capacitor 21 discharges through the switch 23 and an input winding 22*a* of a triggering transformer 22, and thence a high voltage pulse appears at the triggering electrode 24*c* of a flash tube 24. The main storage capacitor 17 discharges through the flash tube 24, producing a brilliant illumination.

After the main storage capacitor 17 has been discharged, a terminal voltage of the main storage capacitor 17 becomes low, and thereby the electric charge stored on the control capacitor 39 is automatically discharged by way of the diode 41, a protecting resistor 20, an input winding 22*a* of a first triggering transformer 22, a switch 23, the resistor 35 and a collector-base path.

By discharging of the control capacitor 39, a negative potential appears at the base circuitry of the transistor 34 and, as a result, the transistor 34 becomes conductive. When the transistor 34 becomes ON, the discharging current from the charging capacitor 37 is supplied to the photo-transistor 31 of the light receiving circuit I. In this case, since the electric charge stored on the control capacitor 39, the response speed of the device becomes fast and the operation of the device is stabilized.

Figure 3:
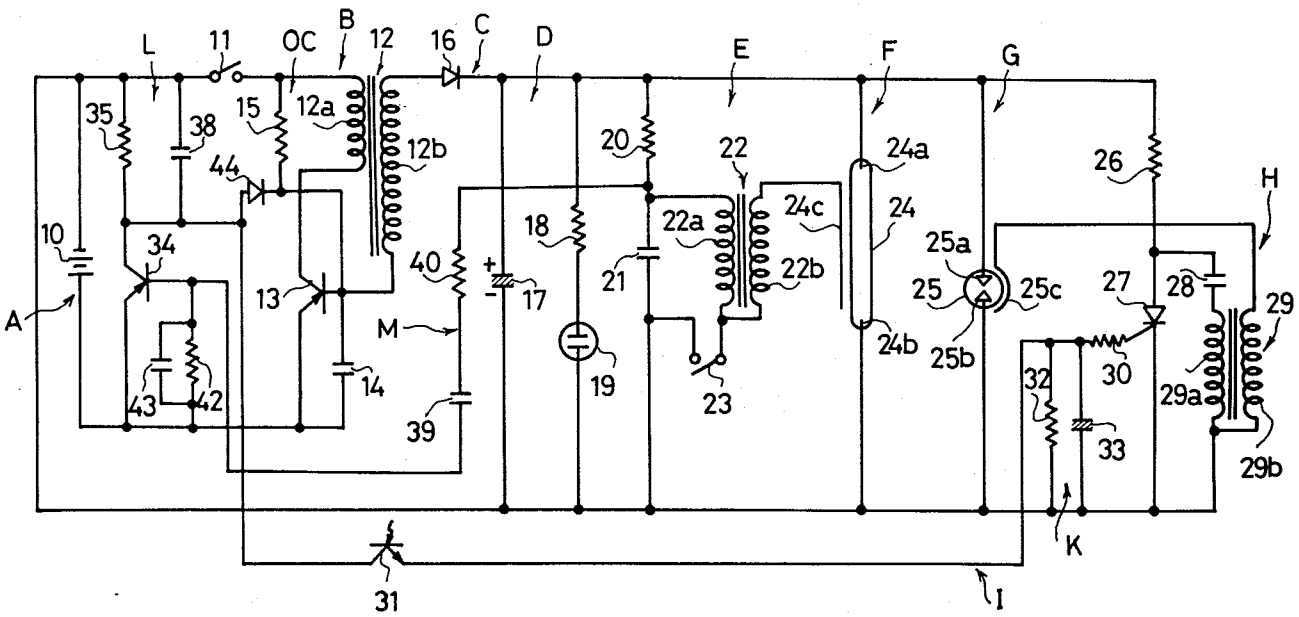
FIG. 3 is an electric diagram of other embodiment of an electric flash device in accordance with the present invention.

FIG. 3 is illustrative of other embodiment of the present invention, and an electric flash device comprises, similar to the device of FIG. 2, a power source circuit A for supplying a direct current power to a pair of loads, a voltage converter circuit B for converting a direct current voltage to an alternating current voltage, a rectifier circuit C for rectifying the alternating current voltage from voltage converter circuit B to a direct current voltage, an electric charge storing circuit D for storing the electric energy to be supplied to a load, a trigger signal generating circuit E for generating a triggering signal, a flash tube circuit F including a flash tube 24, a quenching circuit G for quenching the flash tube 24, a quench signal generating circuit H for actuating the quenching circuit G, a light receiving circuit I, a driving power source circuit L for supplying power to the light receiving circuit I, and a power source control circuit M for controlling the driving power source circuit L. Particularly, the driving power source circuit L includes a second power source switch in the form of a transistor 34 connected to a battery 10 by way of a protecting resistor 35 in parallel relationship, a voltage stabilizing means for stabilizing the voltage of the power source switch element, and oscillation stopping means for stopping the oscillation of the voltage converter circuit B when the trigger signal generating circuit E activites. The voltage stabilizing means comprises a resistor 42 connected between a base electrode and an emitter electrode, and a capacitor 43 which is connected in parallel with the resistor 42. The oscillation stop means includes a diode 44 of which an anode electrode is connected to a collector electrode and of which cathode electrode is connected to a base electrode of a transistor 13 of the voltage converter circuit B. The power source control circuit M are provided between the driving power source circuit L and the trigger signal generating circuit E. In the power driving source circuit M, series connected control capacitor 39 and a protecting resistor 40 are connected between a base electrode of the transistor 34 and a juncture of a protecting resistor 20 and a trigger capacitor 21 of the trigger signal generating circuit E.

In accordance with the electric flash device of FIG. 3, when the first power source switch 11 is made ON, current flows through a resistor 15, a control winding 12*c* and an oscillating capacitor 14, and the transistor 13 actuates a switching operation to start an oscillating operation of an oscillator circuit OC. The control winding 12*c* of the oscillating transformer 12 is not always required. A high alternating current voltage produced from a secondary winding 12*b* of the oscillating transformer 12 is rectified by the rectifier circuit C, and a high direct current voltage is produced to charge an electric charge on a main storage capacitor 17 of the electric charge storing circuit D. The electric charge is also accumulated in the control capacitor 39 by way of the protecting resistors 20 and 40.

By the electric charge of the control capacitor 39, positive potential appears at the base circuitry of the transistor 34, and thereby the transistor 34 is maintained to be nonconductive state. Further, the electric charge is also stored on the first trigger capacitor 21 and the second trigger capacitor 28.

Figure 4:
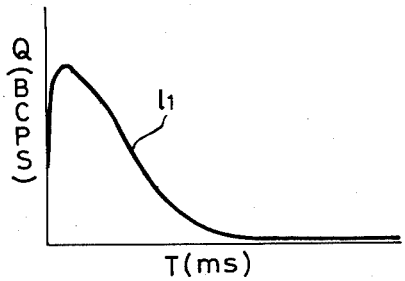
FIG. 4 is a characteristic curve of the conventional electric flash device.

Under these conditions, when the switch 23 is closed, the electric charge of the first trigger capacitor 21 is discharged by way of an input winding 22*a* of a triggering transformer 22 and the switch 23, and thereby a high voltage pulse is produced from an output winding 22*b* of the triggering transformer 22. The high voltage pulse is applied to the trigger electrode 24*c* of the flash tube 24 and the flash tube 24 generates a flash light as is shown by a curve $l_1$ of FIG. 4.

When the synchronous switch is closed, a closed loop is formed by the switch 23, the input winding 22*a* of the triggering transformer 22, the protecting resistor 40, the control capacitor 39, the transistor 34, the protecting resistor 35. The electric charge of the control capacitor 39 is discharged through the above described closed loop so long as the switch 23 is closed, and thence the negative potential is induced in the base circuitry of the transistor 34 to turn the transistor 34 ON. In the condition that the transistor 34 is made ON due to the variation of the base potential thereof, a current loop is formed by a base electrode of the transistor 13, the diode 44, the collector-base path of the transistor 34, the capacitor 43 and the resistor 42. Positive potential is, therefore, applied to the base current due to current which flows through the above described current loop, and the oscillating operation is ceased because the oscillating transistor 13 is short-circuited.

Figure 5:
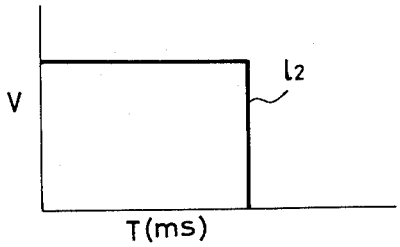
FIG. 5 is a characteristic curve of an electric flash device in accordance with the invention.

Moreover, when the transistor 34 becomes conductive state, stabilized voltage shown by a curve $l_2$ of FIG. 5 is applied to the photo-transistor 31 by the aid of the diode 44 and, as a result, current flows by way of the transistor 34 and the photo-transistor 31 to a gate electrode of the thyristor 27 of the quench triggering circuit H, since the photo-transistor 34 has already become conductive state in response to the quantity of the reflected light from an object to be illuminated. The current which flows by way of the transistor 31 is supplied to an integration circuit K, and thereafter a gating signal is supplied to the thyristor 27 when the charging voltage of the integration capacitor 33 reaches to the predetermined value.

Figure 6:
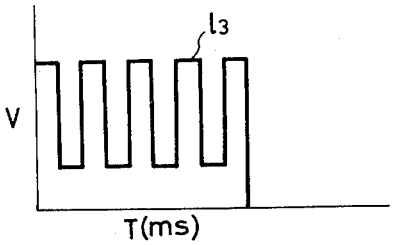
FIG. 6 is a characteristic curve of an electric flash device of the invention.

FIG. 6 shows a typical voltage applied to the photo-transistor 31 in case the voltage stabilizing means including the diode 44 is not provided in the driving power source circuit L.

As is best shown by a curve $l_3$ of FIG. 6, the voltage to be applied to the transistor 31 rise to three volts at the same time and/or approximately same time with the flash timing of the flash tube 24 and fluctuates shown by the curve $l_3$. Accordingly, good characteristics of the device can not be obtained.

On the other hand, since the device of FIG. 3 is equipped with the diode 44, the oscillating transistor is maintained to be OFF and thereby the oscillating operation is ceased during the flash tube 24 flashes, and the voltage shown in FIG. 5 is applied to the light receiving circuit I. Accordingly, the operation of the flash light controlling member is stabilized.

Figure 7:
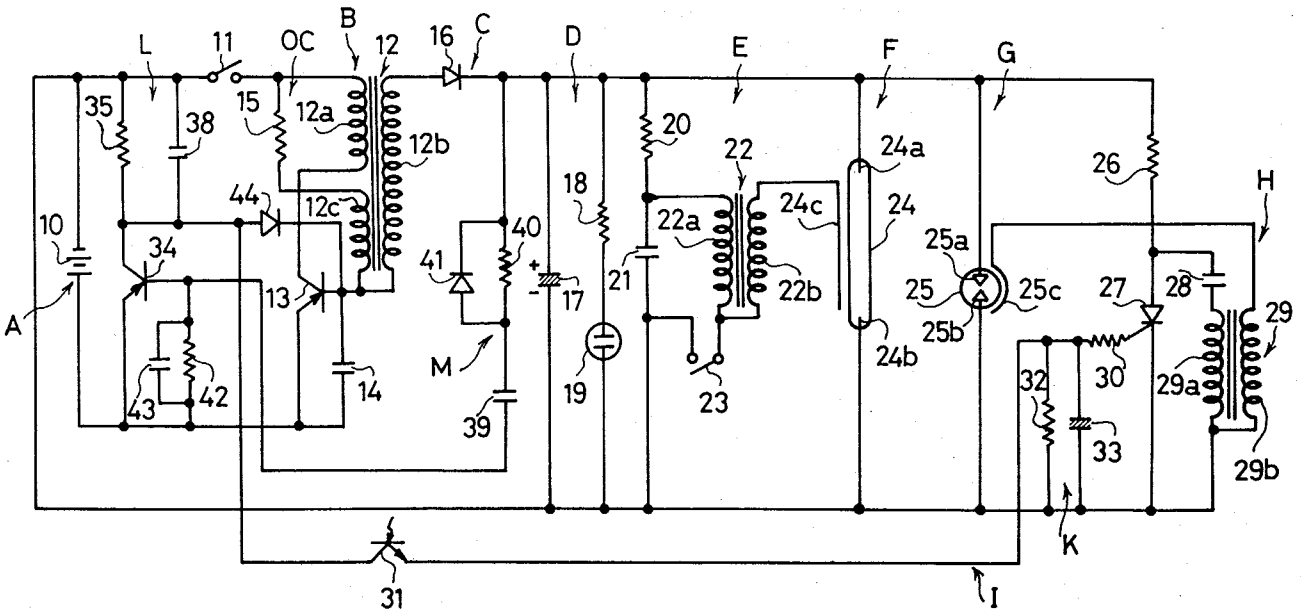
FIG. 7 is an electric diagram of further embodiment of an electric flash device in accordance with the invention.

FIG. 7 illustrates a modification of the electric flash device of FIG. 3. In the device shown in FIG. 7, a power source control circuit M is provided a driving power source circuit L and an electric charge storing circuit D. Namely, a control capacitor 39 is connected to base circuitry of a transistor 34 of the driving power source circuit L, and parallel connected a protecting resistor 40 and a diode 41 are connected between a diode 16 of a rectifier circuit C and a main storage capacitor 17 of the electric charge storing circuit D.

According to the device of FIG. 7, when a synchronous switch 23 is closed and thereby a flash tube 24 flashes, electric charge stored on the control capacitor 39 discharges through the diode 41. By the discharge of the control capacitor 39, the transistor 34 is also turned ON. In this case, it is hard to control the flash timing, since the transistor 34 is, generally, made turn ON immediately after the flash tube 24 flashed. It is, therefore, required to fast the response of the driving power source circuit L. According to the device of FIG. 7, the operation is made fast as well as it is stabilized by means of providing the diode 41.

Figure 8:
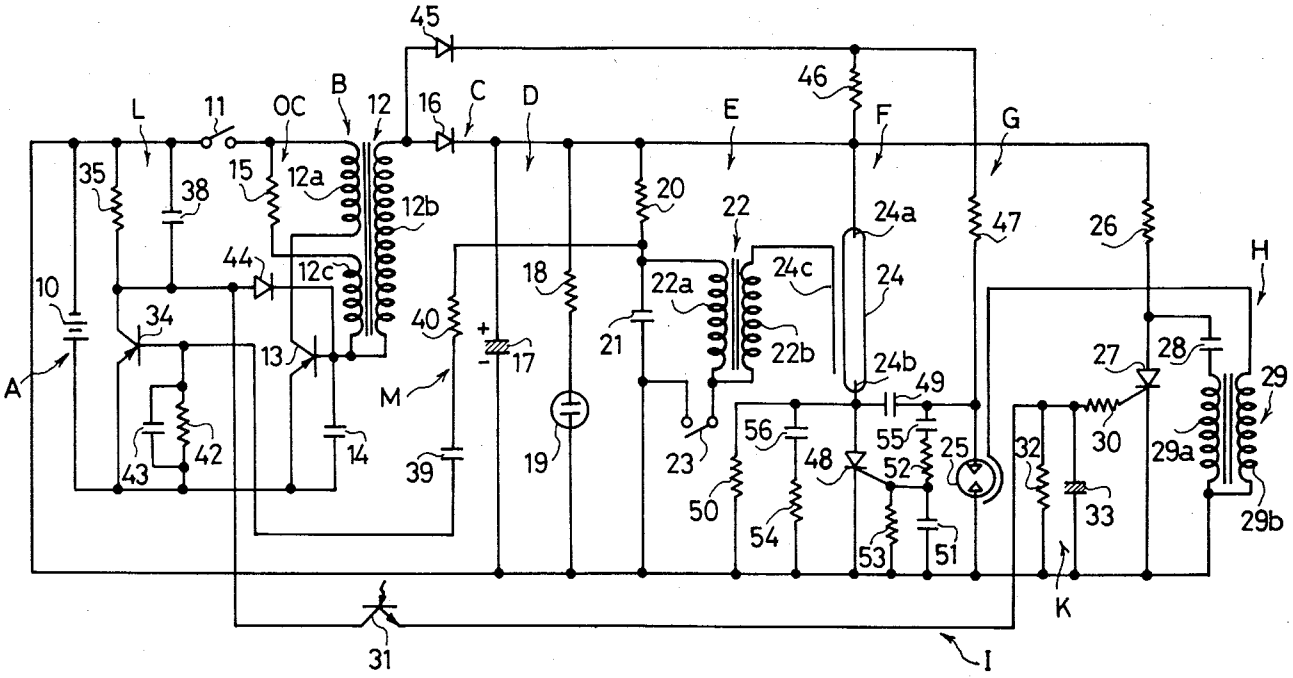
FIG. 8 is an electric diagram of an embodiment of an electric flash device of the invention.

FIG. 8 shows an overmore embodiment of the electric flash device in accordance with the present invention. In the electric flash devices shown in FIG. 8 further comprises oscillation stopping means for stopping the operation of an oscillator circuit OC during a flash tube 24 of a flash tube circuit F flashes and means for making the repetition of flash of the flash tube 25.

In more detail, a quenching circuit G is provided between a voltage converter circuit B and the flash tube circuit F as is shown in FIG. 8.

The quenching circuit G is constructured by a diode 45, a protecting resistor 47, a quenching element in the form of a quench tube 25, a thyristor 48, a commutation capacitor 49, a commutation resistor 50, a noise protection capacitor 51, protecting resistors 52, 53 and 54 and capacitors 55 and 56. A cathode electrode of the diode 45 is connected to a secondary winding **12*b* of an oscillating transformer 12**.

To an anode electrode of the diode 45 connected is the quench tube 25 by way of the resistor 47. The thyristor 48 is connected in parallel with the quench tube 25 by way of the commutation capacitor 49.

In the quenching circuit G, the resistor 52 and the capacitor 55 are used for applying a reverse voltage to a gate electrode of the thyristor 48 when the quench tube 25 actuates and are also used for turning the thyristor 45 ON simultaneously when the flash tube 24 commences the flash operation. The resistor 54 and the capacitor 56 serve as means for stabilizing ON and OFF operations of the thyristor 48.

When the flash tube 24 flashes, electric charge is charged on the commutation capacitor 49 by way of the diode 45, the resistor 47 and the resistor 50, and the thyristor 48 is biased forwardly by the resistor 52 and the capacitor 55. When the quench tube 25 discharges, the electric charge of the commutation capacitor 49 is discharged through the quench tube 25, and thereby the thyristor 48 is reversely biased to be nonconductive. By turning OFF of the thyristor 48, the flash of the flash tube 24 is stopped.

According to the device of FIG. 8, a power source control circuit M is provided between a driving power source circuit L and a trigger signal generating circuit E. The voltage converter circuit B stops the operation during the flash tube 24 flashes, and thereby the stabilized operation can be performed. In the quench tube circuit G, other switching element such as, for example, a thyristor, a transistor or the like can be employed in stead of the quench tube 25.

In the device of FIG. 8, resistance value of the resistor 47 must be small in order to make the flash repetition of the flash tube 24, because the thyristor 48 is not turned OFF even when the quench tube 25 becomes conductive, so long as the commutation capacitor 49 is not swiftly charged. To contrary, when the resistance value of the resistor 47 is small, the quench tube becomes conductive state for a long time interval in spite that the quench tube 25 is required to become OFF swiftly. In order to remove the above described drawbacks, the oscillating operation of the voltage converter circuit B is ceased and thereby the current supplied to the quench tube 25 by way of the resistor 47 is swiftly interrupted.

Figure 9:
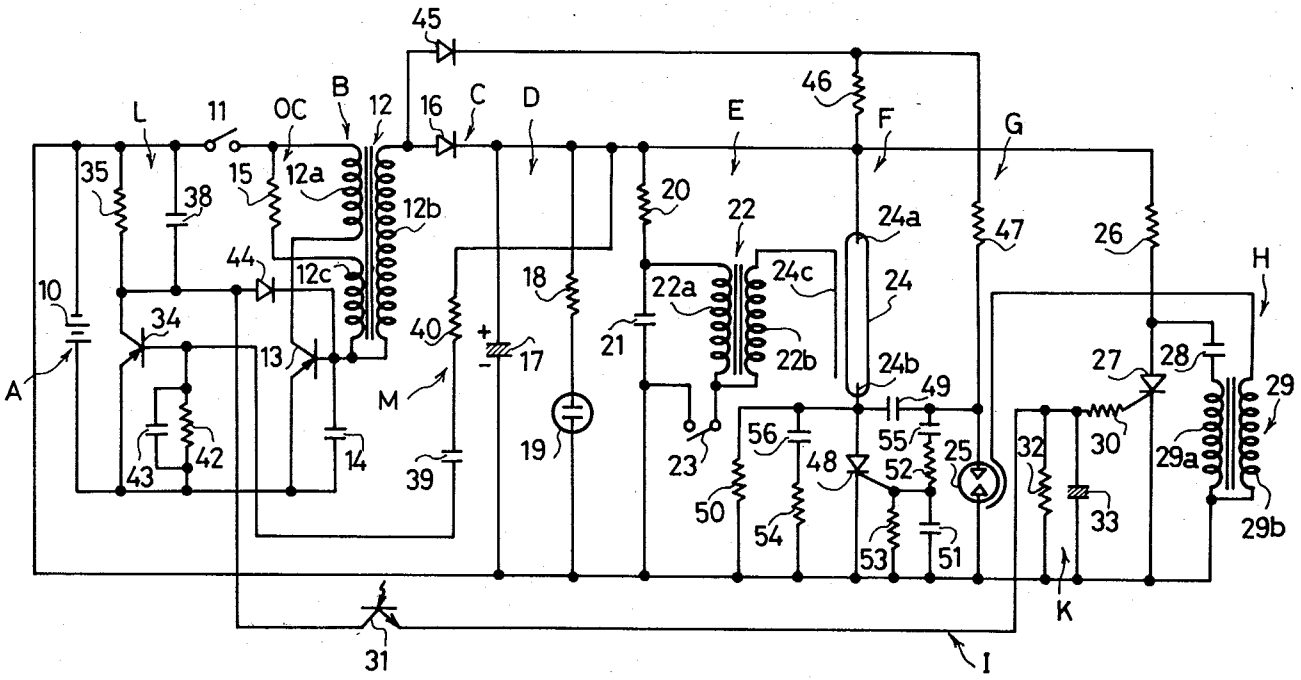
FIG. 9 is an electric diagram of a modification of the electric flash device of FIG. 8.

FIG. 9 shows a modification of the electric flash device of FIG. 8. The only difference between the device of FIG. 9 from the device of FIG. 8 is that a power source control circuit M is provided between a driving power source circuit L and an electric charge storing circuit D. The device of FIG. 9 performs the similar operation with that of the device of FIG. 9 and having same advantages with those of the device of FIG. 8.

Although NPN typed transistors are used in the above embodiments, PNP typed transistor can also use according to the present invention, and the same operations can be performed as well as the same advantages are obtained.

In view of above, it will be seen that the several objects of the invention are achieved and other advantageous results are attained.

While a preferred embodiments of the invention has been shown and described, it will be apparent to those skilled in the art modifications can be made without departing from the principle and the spirit of the invention, the scope of which is defined in the appended claims. Accordingly, the foregoing embodiments are to be considered illustrative, rather than restricting of the invention and those modifications which come within the meaning and range of equivalency of the claims are to be included herein.

What is claimed is:

1. An electric flash device comprising:

electric power supplying means for supplying electric power to a load;

electrical energy storing means for storing electrical energy supplied from said electric power supplying means;

flash light generating means for converting the electric energy stored in said electrical energy storing means to light energy;

trigger signal generating means for triggering said flash light generating means;

flash light control means for controlling the quantity of flash light;

driving power source means for actuating said flash light control means; and control means for controlling said driving power means;

wherein said electric power supplying means comprises a direct current power source circuit for converting a direct current voltage to an alternating current voltage, and a rectifier circuit for rectifying the alternating current voltage to a direct current voltage;

said electric energy storing means comprises an electric charge storing circuit including a main storage capacitor for storing electric charge from said rectifier circuit;

said flash light generating means comprises a flash tube circuit including a flash tube;

siad trigger signal generating means comprises a triggering circuit for triggering said flash tube;

said flash light control means comprises a control circuit for stopping the flash operation of said flash tube of the flash light generating means, a control signal generating circuit for actuating said control circuit, and a light measuring circuit for sensing a reflecting light which is produced by said flash tube and is reflected from an object to be photographed for actuating said control circuit;

said driving power source means comprises a driving power source circuit including a switch element (34) for enabling said battery of the direct current power source circuit to supply electrical energy from said battery to said light measuring circuit;

said switch element being conductive to supply electric power at least during the activation of said flash tube circuit;

said control means controlling said driving power source means to control said switch element at least during the activation of said flash tube circuit, said control means having voltage stabilizing means for preventing voltage instabilization due to the operation of a switching element of an oscillator circuit of said converter circuit during the activation of said flash tube circuit and for stabilizing the voltage applied to said light measuring circuit.

2. An electric flash device as claimed in claim 1, wherein said power source controlling and circuit comprises means for actuating said driving power source circuit when the trigger signal generating means is activated.

3. An electric flash device as claimed in claim 2, further comprising oscillation stopping means for stopping the operation of said electric power supplying means when said trigger signal generating means is activated.

4. An electric flash device as claimed in claim 2, wherein said driving power source circuit of the driving power source means includes a charging capacitor for charging electric charge from said direct current power source circuit and a power source switch element for supplying the electric charge of said charging capacitor to a light sensitive element of the light receiving circuit.

5. An electric flash device as claimed in claim 2, wherein said power source controlling circuit includes a control capacitor for controlling the driving power source circuit when said trigger signal generating circuit is activated.

6. An electric flash device as claimed in claim 2, said driving power source circuit comprising a charging capacitor for charging an electric charge supplied from a direct current power source, and a power source switch element controlled by said power source control circuit such that said power source switch element is turned ON when said trigger signal generating means activates its triggering operation.

7. An electric flash device as claimed in claim 6, wherein said driving power source circuit comprises oscillation stopping means for stopping the oscillating operation of the voltage converter circuit when the flash tube circuit activates the flash operation.

8. An electric flash device as claimed in claim 6, wherein said quenching circuit has oscillation stopping means for stopping the oscillating operation of the voltage converter circuit.

9. An electric flash device as claimed in claim 1, said power source controlling circuit further comprising means for actuating said power source circuit when said flash light generating means activates flash operation.

10. An electric flash device as claimed in claim 9, said power source controlling circuit comprising a charging capacitor for charging an electric charge supplied from a direct current power source and a power source switch element controlled by said power source control circuit such that said power source switch element is turned ON when said flash light generating means activates its flash operation.

11. An electric flash device as claimed in claim 9, further comprising oscillation stopping means for stopping the operation of said electric power supplying means during said flash light generating means activates the flash operation.

12. An electric flash device as claimed in claim 9, wherein said power source, controlling circuit comprises a control capacitor for controlling the driving power source circuit when said flash tube circuit activates, and means for stabilizing the control operation.

13. An electric flash device as claimed in claim 1, wherein said driving power source circuit comprises a power source switch element which is made to turn ON when said trigger signal generating means activates the triggering operation, so that current is supplied to said light measuring circuit.

14. An electric flash device as claimed in claim 1, wherein said driving power source circuit includes a power source switch which is connected to a direct current power source circuit and for supplying the electric power from said direct current power source circuit to the light measuring circuit.

15. An electric flash device as claimed in claim 14, wherein said driving power source circuit further includes means for stabilizing the switching operation of said power source switch element.

16. An electric flash device as claimed in claim 1, wherein said driving power source circuit comprises a power source switch element which is made to turn ON when said flash light generating means performs the flash operation.

* * * * *